United States Patent [19]

Cohen et al.

[11] Patent Number: 4,932,595

[45] Date of Patent: Jun. 12, 1990

[54] SIZE REDUCTION SYSTEM FOR PLASTIC ARTICLES

[75] Inventors: Ahren L. Cohen, Kingstown, R.I.; Thomas J. Dumaine, Attleboro; Vincent N. Picarello, Pepperell, both of Mass.

[73] Assignee: John Brown Inc., West Warwick, R.I.

[21] Appl. No.: 313,509

[22] Filed: Feb. 22, 1989

[51] Int. Cl.[5] ..... B02C 18/22

[52] U.S. Cl. ..... 241/99; 241/246

[58] Field of Search ..... 241/99, 100, 246, 247, 241/224, 225, 186 A, 242, 243, 152 A

[56] References Cited

U.S. PATENT DOCUMENTS 1,298,289 3/1919 Byrd ..... 241/242 X
4,703,899 11/1987 Lodovico ..... 241/225 X
4,709,864 12/1987 Henne et al. ..... 241/225 X

FOREIGN PATENT DOCUMENTS 27024 12/1954 Finland ..... 241/224
329027 4/1972 U.S.S.R. ..... 241/225

*Primary Examiner*—Mark Rosenbaum
*Attorney, Agent, or Firm*—Burnett W. Norton

[57] ABSTRACT

Size reduction system for processing plastic articles is disclosed. The system includes granulating means operable to comminute articles delivered to it, an article feed means which serves to move articles in a generally vertical path from a loading point to the granulating means while simultaneously crushing each of the articles into a compacted form. The feed means includes projections which operate to pull the articles into the article feed means while concurrently puncturing those articles. The invention provides a simple and efficient means for processing articles into reduced size for reclaiming. The invention further provides a system which utilizes minimum operating space by virtue of the vertical orientation and integration of the feed system relative to the granulator and the functioning of the feed system to compact articles preliminary to entry into the granulator, thereby allowing for a granulator of reduced size.

8 Claims, 3 Drawing Sheets

SIZE REDUCTION SYSTEM FOR PLASTIC ARTICLES

FIELD OF THE INVENTION

The present invention is directed to a size reduction system for plastic articles and is directed, more particularly to a size reduction system operable to receive and crush plastic articles such as containers for beverages, food, motor oil, detergent or other household or industrial articles while simultaneoulsy delivering such articles to a granulator operable to comminute the articles received by the granulator in a crushed condition. It is within the scope of the invention to include means such as one or more projections on the article crushing system for engaging the articles and pulling them into the crushing mechanism while simultaneously acting to puncture and tear the articles to be crushed and granulated.

BACKGROUND OF THE INVENTION

Conventional size reduction equipment for granulating plastic materials commonly include as essential elements a so-called barrel or cutting chamber within which a rotor is mounted for rotation on a support shaft. Knives are fixed coaxially on the surface of the rotor and upon rotation of the rotor the rotor knives rotate in close proximity to one or more stationary bed knives secured within the cutting chamber. Plastic material fed into the cutting chamber is comminuted by the cooperative effect of the moving rotor knives and the stationary bed knives.

The usual method of feeding plastic material into the cutting chamber is by conveying the material into a stationary chute through which the material is free to fall by gravity through an opening at the top of the cutting chamber. While this technique works well in conventional industrial applications it is not acceptable in certain environments, one being where light weight containers with cylindrical configuration could bounce around freely without being engaged by rotating knives against fixed bed knives.

In the promotion of environmental interests it is becoming increasingly popular for plastic containers such as beverage bottles to be returned by the customer to the point where the containers are sold or other collection center where the containers are gathered for ultimate delivery to a location where they are comminuted and the resultant plastic particles recycled. Recent techniques have contemplated that the consumer returning the used plastic containers would feed them into a device at the collection center which may be the point of purchase, perhaps being rewarded by receiving a deposit fee automatically as each plastic container is fed into the granulation system. Since it will be appreciated that these steps represent the reverse of inserting a coin or coins into a vending machine to obtain a beverage, for example, the system of plastic reclamation here under discussion is sometimes called "reverse vending".

Typically reverse vending is carried out at locations wherein the plastic containers are sold. This dictates that the reversing vending machine must be safe to operate, consume a minimum amount of floor space, granulate to reduce bulk density, avoid any inadvertant discharge of the granulated plastic out of the granulator, be simple in operation and be completely reliable in use. The present invention admirably fulfills all of these objectives.

BRIEF DESCRIPTION OF THE INVENTION

In brief, the invention comprises a granulator which is supported on the internal framework of an enclosure. A receptacle is positioned below the granulator for receiving the plastic material discharged from the granulator.

The granulator has an infeed opening at the top of its cutting chamber. A vertically mounted article feed system which incorporates an auger screw is arranged coaxially with the granulator infeed opening. The auger screw is enclosed by a member having a smooth interior wall spaced slightly from and converging toward the major diameter of the auger screw. The upper end of the auger screw is formed as a shaft coupled to the depending end of a drive shaft coaxially arranged with said auger screw shaft. The drive shaft is driven by a motor to rotate the auger screw.

For introduction of products such as plastic bottles into the auger screw an entry aperature is formed in the wall of the member enclosing the auger screw and at generally a right angle to the auger screw. The aperature is slightly larger than the largest container to be fed to the feed mechanism. A tube slide is connected to the outer wall of the member surrounding the auger screw. Desirably this slide is arranged at a slight angle, say 30° to the horizontal, to permit containers placed thereon to slide into the space between the flight of the auger screw. The aperature is offset from the centerline of the auger screw by generally one-half of the auger screw's major diameter, thereby providing a path for the articles to be readily engaged by the auger screw. The flight of the auger screw may be provided with one or more projections which serve multiple purposes. Firstly, the projections pierce the plastic containers and assist in pulling the containers into the auger screw. Secondly, the projections effect a tearing of the articles so that, for example, if the articles are bottles with caps thereon the air inside the bottles can escape to facilitate crushing of the bottles.

From the foregoing it will be appreciated that the invention is operable to receive plastic articles via a chute for engaging of the articles between the flights of a rotating auger screw. Rotation of the auger screw simultaneously moves the articles downwardly into the granulator while tearing them by means of the projections on the auger screw. At the same time the articles are crushed to a compact size so that a relatively small granulator can be employed to comminute the articles. The auger screw being positioned above the infeed opening of the granulator and generally covering said opening prevents flyback of the granulated material through the infeed opening during the granulation process. Thus, the invention is particularly suitable for granulation of plastic articles where space considerations are important and where easily operated and reliable means are required for granulating plastic articles.

DESCRIPTION OF THE PREFERRED EMBODIMENT

Figure 1:
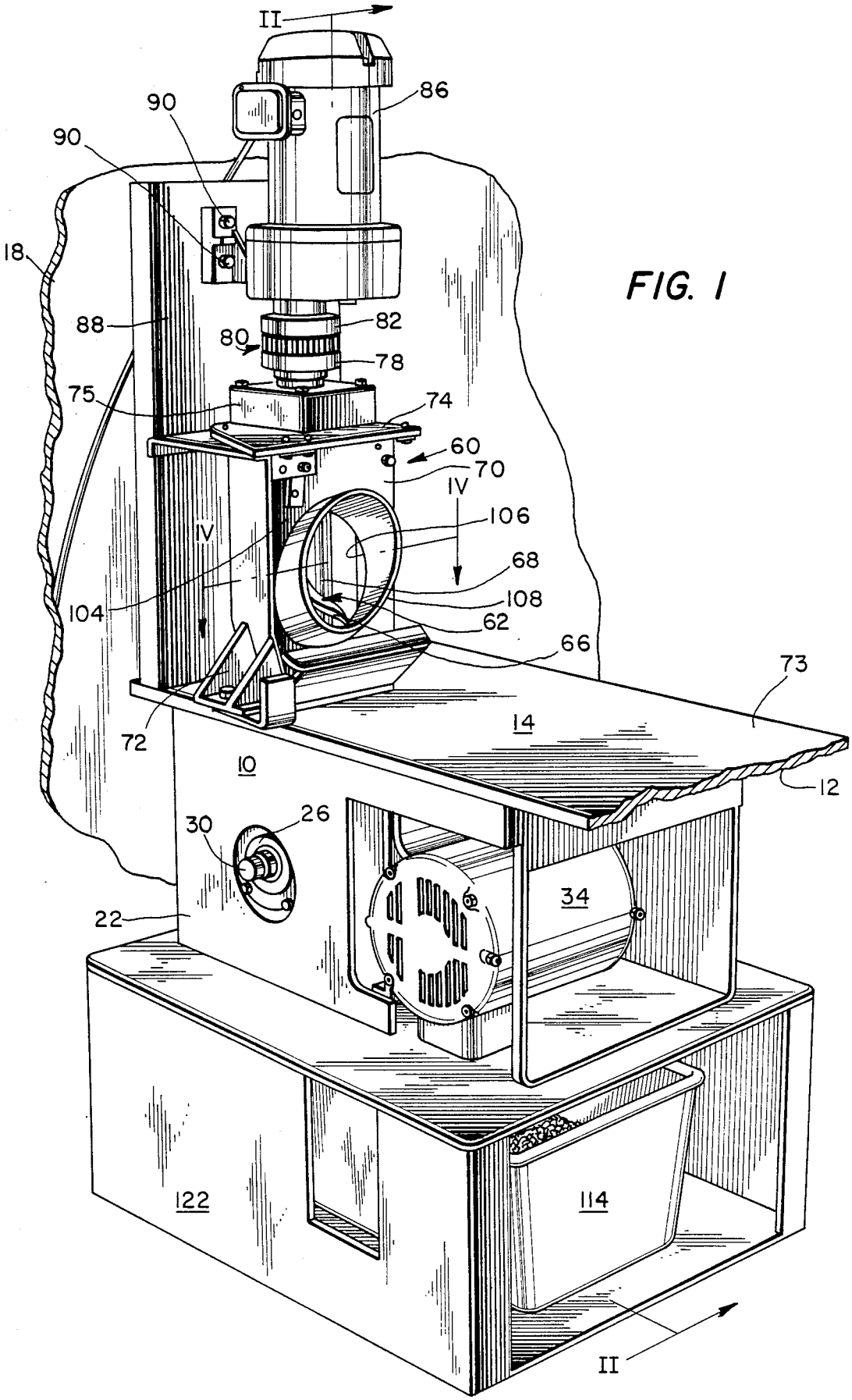
FIG. 1 is a perspective view of the granulator and granulator feed mechanism of the present invention with the parts broken away.
Figures 2, 5:
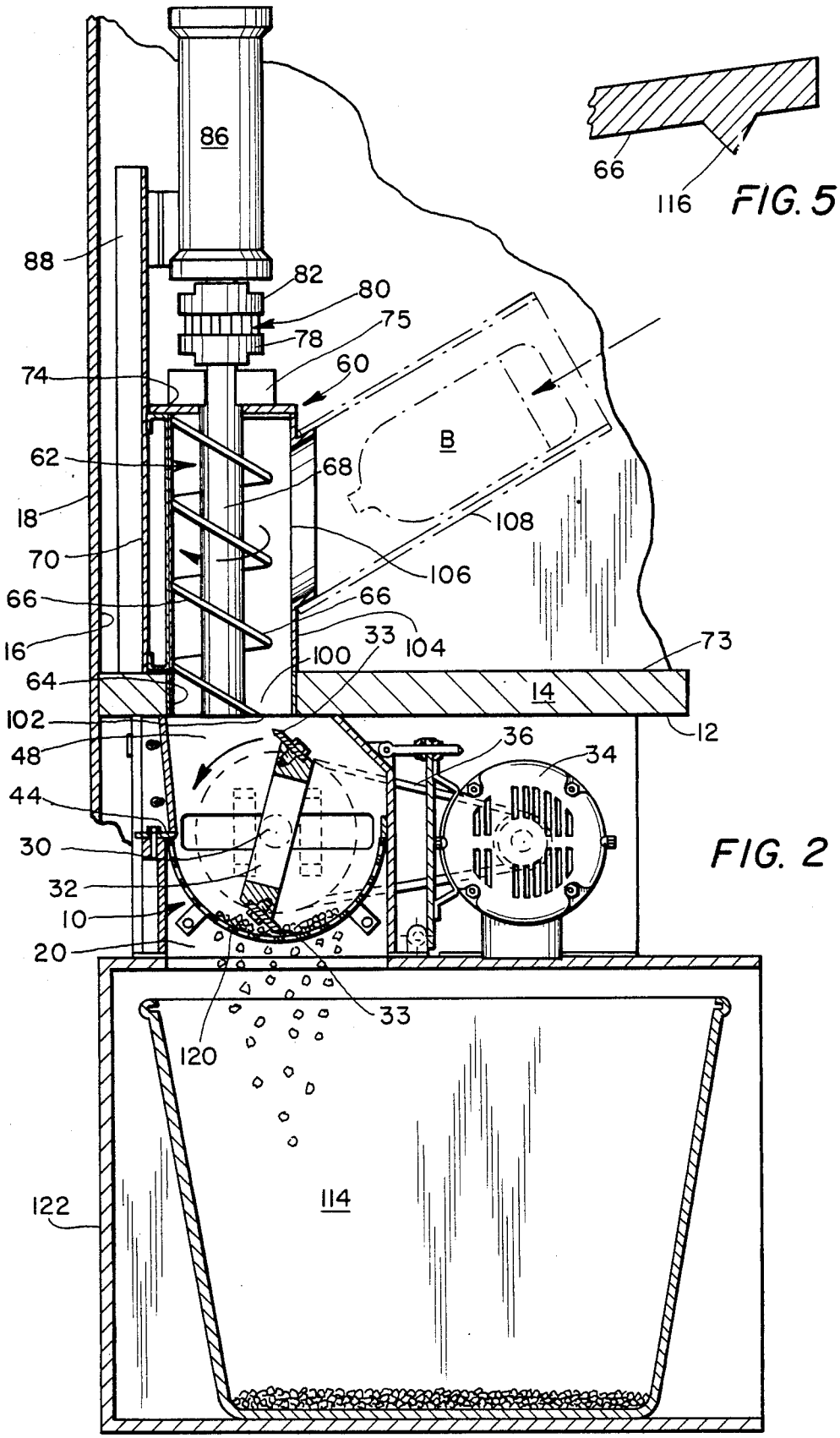
FIG. 2 is a cross sectional taken along lines II—II of FIG. 1.
FIG. 5 is a detailed view of a portion of the auger screw with an article engaging projection mounted therein.

With reference initially to FIG. 1 a granulator 10 is shown as being mounted on the lower side 12 of a shelf 14 affixed to the interior wall 16 of an enclosure 18 within which the granulator is housed. The granulator is generally of conventional configuration such as that manufactured by Cumberland Engineering Division of John Brown Inc., P. 0. Box 6065, Providence, R.I. and identified as Cumberland's Model 8×12, it being understood that the granulator of the present invention may be proportionally smaller in size for reasons to be explained hereinafter. Granulator 10 includes a barrel or cutting chamber 20 (FIGS. 2 and 3) formed with opposing sidewalls 22, 24. Each sidewall 22, 24 is provided with coaxial aperatures within which bearings 26 are seated to support a rotatable shaft 30. A rotor 32 is secured fast on shaft 30. Rotor 32 has a plurality of cutting knives 33 (FIGS. 2 and 3) secured onto its outer surface coaxially with shaft 30 as best shown in FIG. 2. The rotor is driven by means of an electric motor 34 through a drive belt 36, the belt being wrapped on a drive pulley (not shown) on motor 34 and engaged about a driven pulley 38 fast on an outer end of rotor shaft 30. It will be evident that as motor 34 is energized rotor 32 will be rotated to move knives 33 in a rotary path within chamber 20 and in the direction of the arrow as seen in FIG. 2. One or more bed knives 44 fixed to suitable mountings within chamber 20 are positioned in close proximity to the rotational path of rotor knives 33. In consequence plastic materials fed into chamber 20 through an inlet opening 48 at the upper surface of the chamber 20 are granulated as the rotor is operated.

A unique granulator feed mechanism 60 is provided to advance articles such as plastic bottles or containers B into chamber 20 of granulator 10. Feed mechanism 60 includes a vertically mounted auger screw 62 the lower end of which is enclosed within a tubular housing 64. Auger screw 62 includes the usual spiral flight 66 affixed to a central shaft 68. A sheet metal box-like enclosure 70 is secured on the upper surface 72 on shelf 14 by means of brackets 73 which are bolted to the shelf and welded to a sidewall of enclosure 70. The upper end of enclosure 70 provides a cover 74 which mounts a bearing block 75. Block 75 provides a seat for a bearing 76 through which the upper end of shaft 68 is guided as best shown in FIGS. 2. and 3. Bearing 76 acts to prevent axial movement of shaft 68 while affording control in deflection of the shaft. The upper terminus of shaft 68 has one section 78 of a drive coupling 80 secured thereto. The mating section 82 of the drive coupling 80 is affixed to the depending shaft 84 of a gear motor 86. In turn gear motor 86 is secured to an upstanding metal support plate 88 by bolts 90. As is evident in FIGS. 1–3 the lower end of support member 88 is fixed to the upper surface 72 of shelf 14.

Figure 3:
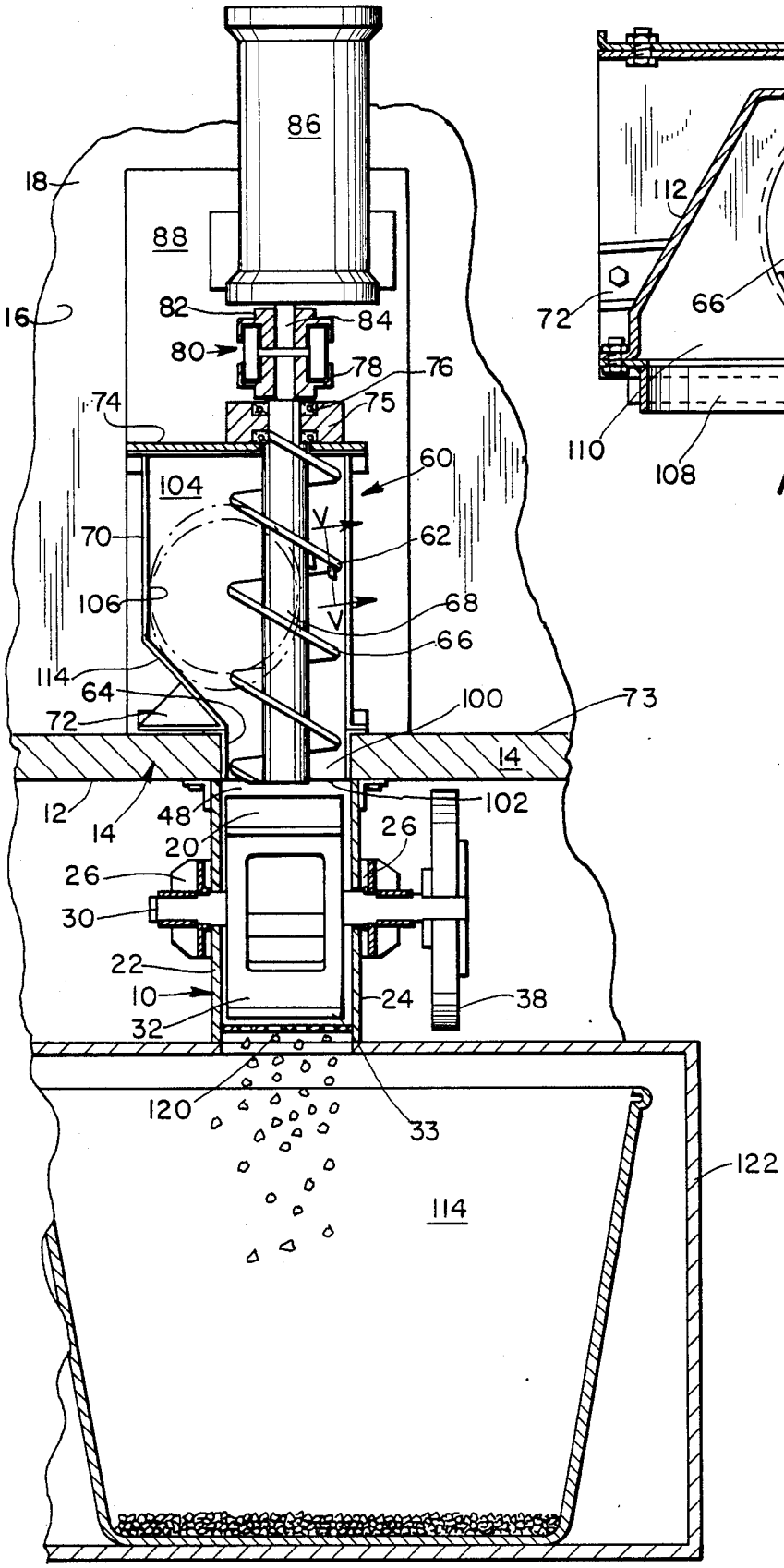
FIG. 3 is a front elevational view of the mechanism of FIGS. 1 and 2.

With attention now particularly to FIGS. 2 and 3 it will be seen that the lower end of auger screw 62 extends through an opening 100 in shelf 14, this opening being aligned with the inlet opening 48 at the upper portion of granulator 10. The diameter of inlet opening 48 is generally equal to the major diameter of flight 66. Thus, flight 66 assists in preventing fly back from the cutting chamber 20 by generally effectively covering inlet opening 48. The lowermost end of shaft 68 and the lower terminus of flight 66 is in the vertical plane of the lower surface 102 of shelf 14 and slightly spaced above the rotational path of rotor knives 33. Further, the alignment of auger screw 62 is such that materials advanced by rotation of the screw 62 will fall under the influence of gravity into chamber 20 to be engaged by the rotor knives 33 on their downstroke, advantageously positioning the articles for efficient cutting action by the rotor knives 33 and the bed knife 44 while limiting fly back of material as it is being granulated.

It has already been discussed that auger screw 62 and its housing 64 are generally confined by an enclosure 70. The front wall 104 of enclosure 70 is provided with an aperature 106 to which a tubular guide chute 108 is attached. The width of chute 108 and the diameter of aperature are configured to be slightly larger than the articles to be granulated. It has been found in practice with plastic beverage bottles that if chute 108 is angled at approximately 30° such beverage bottles will readily slide down the chute from the outer chute end and enter into the tubular housing 64 for engagement in the space between the flight 66 of auger screw 62. An angle of 45° to the horizontal has been found to be satisfactory for the flight with flight spacing being generally equal to the diameter of articles being introduced to the auger screw 62.

Figure 4:
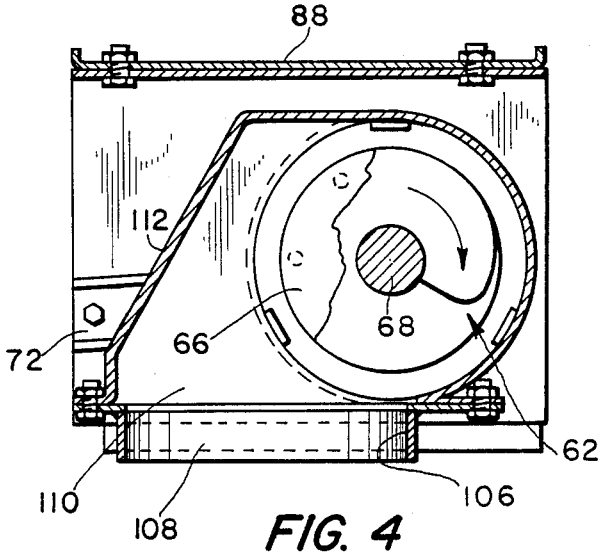
FIG. 4 is a cross-sectional view taken along lines IV—IV of FIG. 1.

As best seen in FIG. 3 aperature 106 is positioned so that the vertical centerline thereof is parallel to and offset from the centerline of auger screw 62 by one-half the major diameter of the auger screw 62. With this arrangement beverage bottles and similar articles sliding into engagement with auger screw 62 are readily seized by the rotating auger screw. This occurs as the articles move into the convergent zone 110 with enclosure 70, this zone being best shown in FIG. 4. The wall 112 which conveys inwardly toward auger screw 62 guides the plastic articles toward the auger screw. A tapering wall 114 connected to the lower end of wall 112 is configured to be funnel shaped so that as the articles are advanced downwardly to the auger screw 64 the articles are compressed and crushed.

To enhance the movement of articles into the space between flight 66 the auger screw 62 may be provided with one or more projections 116 secured thereto as best shown in FIG. 5. These projections 116 operate to seize the articles to be granulated and pull them into the space between the flight as the auger screw is rotated. Additionally, the projections 116 vent to the containers if they should have air or fluid trapped therein so that the crushing action of the auger screw is enhanced as the containers are moved downward to granulator 10.

The operation of the apparatus of the present invention will be reasonably apparent from the above description. The invention provides a unique size reduction system for plastic articles. By way of example let it be assumed that plastic beverage bottles B of the type shown in broken lines in FIG. 2 are to be granulated in a typical operation by which the plastic in the bottles is to be reclaimed. The initial step in operation of the system is to energize motors 86 and 34 to thereby initiate rotation of auger screw 62 and rotor 32. With the auger screw 62 rotating at 60 revolutions per minute bottles B are placed in chute 18 for free sliding movement downwardly. As previously stated the chute is desirably inclined downwardly toward aperature 106 at a suitable angle to induce sliding of the bottles, an angle of 30° being found to be satisfactory. The bottles B are placed in the chute, say, at a rate of about one every 5 seconds with the auger screw rotating at the rate stated. It is to be noted that in practice with the present invention bottles B may be fed to auger screw 62 either base first or neck first. Because the entrance aperature 106 is sized to permit free sliding movement of the bottles B therethrough aperature 106 is offset from the auger screw centerline by one-half the major diameter of auger screw 62 so that the bottles are efficiently guided in the space between the flight 66 as the flight spirals downwardly. Auger screw 62 is selected to have spacing between the flight generally equal to the diameter of bottles B. As earlier stated, projection 116 cooperates with the action of the auger screw rotation to seize the bottles, pull them into the auger screw 62 and puncture the bottles. The rotational action of auger screw 62 coupled with the restraining action of the converging walls 112 and 114 acts to compress the bottles as they are moved toward inlet opening 48. This compressing action permits the use of a relatively compact granulator in the system. As the compressed bottles are dropped into the granulator 10 the moving rotor knives 33 operate cooperatively with the stationery bed knives 44 to comminute the compressed bottles. As is known in the art the granulating action continues until the material is reduced in size to a point wherein it is free to fall through a screen 120 with holes of predetermined size at the lower side of the chamber 20 to be deposited in a collection bin 114 enclosed within a cabinet 122.

As will be apparent to one skilled in the art, various modifications can be made within the scope of the aforesaid description. For example, while the invention has been described for use in processing plastic articles it could be utilized for processing articles of other materials such as, say, thin aluminum containers. Such modifications being within the ability of one skilled in the art form a part of the present invention and are embraced by the appended claims.

What is claimed is:

1. Size reduction system for articles comprising, a substantially enclosed cutting chamber arranged to receive plastic articles, rotatable cutting means within said chamber operable cooperatively with fixed cutting means within said chamber to comminute said articles when delivered into said chamber through an opening in an upper section of said chamber, article feed means arranged with said chamber opening, said article feed means having an inlet and an outlet, and including rotatable auger screw means operable to engage said articles passed through said inlet and convey said articles to said outlet to said chamber opening for delivery into said chamber, an enclosure generally surrounding and coterminous with said auger screw means and operable to retain said articles in engagement with said auger screw means as the articles are conveyed thereby, an article engaging surface within said enclosure positioned to engage said articles as they are conveyed from said inlet to said outlet, said surface being inclined toward said auger screw means, said articles during conveyance by said auger screw means being engaged on said surface and forced into compressing engagement with said surface during rotation of said auger screw means to thereby crush said articles prior to delivery into said chamber.

2. A size reduction system as set forth in claim 1 including means for guiding said articles to said auger screw means.

3. A size reduction system as set forth in claim 1 wherein said rotatable cutting means includes knives rotatable about a horizontal axis, and said auger means is arranged to deliver said articles into said chamber for engagement by said knives during their downward movement.

4. A size reduction system as set forth in claim 1 wherein the vertical centerline of said inlet is parallel to and offset from said auger screw means one-half of the major diameter of said auger screw means.

5. A size reduction system as set forth in claim 1 wherein said auger screw means includes a spiral flight, the spacing between adjacent sections of said flight being generally equal to the diameter of said articles.

6. A size reduction apparatus as set forth in claim 5, including projection means mounted on said flight for engaging said articles.

7. A size reduction system as set forth in claim 1 wherein the major diameter of the auger screw means is generally equal to the diameter of said opening in said chamber.

8. A size reduction system as set forth in claim 1 wherein said article feed means includes projection means operable to puncture said articles.

* * * * *